United States Patent [19]

Briggs et al.

[11] 4,132,353

[45] Jan. 2, 1979

[54] WINDOW HEATERS

[75] Inventors: Eugene C. Briggs; Robert F. Shaftner, both of Bowling Green, Ky.; Harry J. Giambrone, Dayton, Ohio

[73] Assignee: Koehring Company, Brookfield, Wis.

[21] Appl. No.: 784,056

[22] Filed: Apr. 4, 1977

[51] Int. Cl.[2] ..... F24H 3/10

[52] U.S. Cl. ..... 236/10; 98/94 AC; 126/110 B; 126/116 B

[58] Field of Search ..... 126/110 R, 110 B, 116 R, 126/116 B; 236/10; 219/494; 62/262; 98/94 AC

[56] References Cited

U.S. PATENT DOCUMENTS

| | | | |
|---|---|---|---|
| 2,582,066 | 1/1952 | Resek | 126/110 B |
| 2,619,578 | 11/1952 | Jepson et al. | 219/494 X |
| 2,744,516 | 5/1956 | Hubbard | 126/110 B X |
| 2,864,359 | 12/1958 | Vaughn | 126/116 B X |
| 3,140,706 | 7/1964 | Block et al. | 126/110 R |
| 3,306,182 | 2/1967 | Schwartz | 62/262 X |
| 3,513,634 | 5/1970 | Angonese et al. | 62/262 X |
| 3,680,541 | 8/1972 | Honaker, Jr. | 126/110 B X |
| 3,725,640 | 4/1973 | Kunz | 126/110 B X |

*Primary Examiner*—William E. Wayner
*Assistant Examiner*—William E. Tapolcai, Jr.
*Attorney, Agent, or Firm*—Jerome P. Bloom

[57] ABSTRACT

A thermostat controlled window furnace for heating a room features a construction wherein the air required for its operation is comprised on the one hand of outside air used solely for combustion purposes, to service a heat transfer component, and on the other hand of air drawn from the room, to be heated in passage through the heat transfer unit and returned to the room to elevate its temperature. The arrangement provided for inflow of room air insures that it will exhibit the general temperature of the room. The furnace not only provides for an effective separation therein of outside air and room air which is utilized thereby but for a return to the room of heated air in a manner to inhibit a chance or premature intermingling thereof with that portion of the room air being drawn into the furnace the function of which, in part, is to signal the general temperature of the room to a furnace thermostat.

28 Claims, 5 Drawing Figures

AMBIENT OR OUTSIDE AIR
EXHAUST
RECIRCULATED ROOM AIR
HEATED AIR

WINDOW HEATERS

The thermostat which senses the room temperature is so positioned within the furnace housing as to indirectly sense the temperature of the outside air drawn to the furnace for combustion purposes at the same time it directly senses the temperature of inflowing room air, to thereby introduce a heat control factor which takes into consideration the temperature of the outside air.

The furnace housing has an improved construction which contributes to the ability of the furnace to operate at a comparatively high efficiency. In preferred embodiments of the invention the separate blowers utilized for controlling the flow of room and outside air have a common drive shaft extending from a single small motor in an arrangement minimizing requirements for shaft bearings and supports.

BACKGROUND OF THE INVENTION

This invention relates to improvements in window furnaces rendering them more efficient and satisfactory in use, adaptable to a wide variety of applications and unlikely to malfunction.

Window type furnace units as heretofore known exhibit a relatively low efficiency in their operation. Contributing to this condition is the nature of the air flow pattern normally developed in such apparatus in drawing air to and through the furnace in a heating cycle, producing heated air, and delivering the heated air to the room being serviced. It is often the case that some of the heated air being delivered to the room is immediately caught up in the flow of air being drawn into the furnace. Since one function of the room air entering the furnace is to signal the general temperature of the room to an included thermostat, this will cause the thermostat to have a false reading and correspondingly an improper function of the furnace.

Further problems evidenced in the use of prior art window furnaces or heaters stem from the fact that they incorporate grills in a manner and in such locations as to produce dangerous hot spots on and in the vicinity of the heater housing. A further deficiency in the design of many prior art window furnaces is their inability to take into consideration, in the operation thereof, the changing temperature of outside air.

It is to the solution of the above noted problems that the improvements of the present invention are primarily directed. In the process of the invention development not only have such problems been generally solved but its embodiments have produced heaters the construction of which has been simplified.

SUMMARY OF THE INVENTION

A window furnace according to the present invention has an improved housing construction wherein means defining a chamber housing combustion apparatus provide a distinct separation thereof from a chamber embodying a heat exchanger which is serviced by this combustion apparatus. The combustion apparatus utilizes outside air which freely enters the chamber in which such apparatus is embodied but is precluded from passage to the chamber housing the heat exchanger.

The front of the furnace housing, which is presented to the room being serviced, is provided by a uniquely constructed cover assembly the front panel of which is distinguished by the absence of openings through which air may flow to or from the furnace. The front cover assembly is formed as a hollow structure which defines an entrance chamber which is in open communication with the chamber embodying the heat exchanger. The walls of the entrance chamber incorporate openings through which air having the general temperature of the room being serviced is drawn. Such openings, however, are limited to relatively protected and sheltered areas to sides and top of the cover assembly. The air drawn to the entrance chamber is induced to flow to and through the heat exchanger and back into the room being serviced by way of an insulated duct housed in the entrance chamber and opening from the bottom thereof. By reason of this construction the heated air exits from an opening from the furnace which is sheltered and protected and located at the bottom of its front cover assembly. The pattern of air flow to, through, and from the furnace is such to avoid any perceptible amount of the heated air entering the room being immediately recycled to and through the furnace. This insures that the room air being drawn into the furnace, in a working cycle thereof, will at all times be at a temperature which corresponds, generally, to the actual temperature to which an occupant of the room being serviced is exposed.

In the preferred embodiment illustrated the furnace controls include a thermostat located in the entrance chamber in a position to continuously sense the temperature of the room air being drawn into the furnace. At the same time this thermostat is positioned adjacent a surface portion of the wall structure which defines the perimeter of that chamber which receives outside air, which surface portion is not insulated and therefore reflects the temperature of outside air. Therefore, this thermostat not only continually senses the room temperature but it simultaneously senses every change in the temperature of the outside air. This results in a highly efficient and effective control of the furnace to insure that the temperature of the air being returned to the room being serviced will take into consideration outside air temperatures.

The sum result is to provide a window furnace which is not only efficient in operation but extremely safe in use.

Preferred embodiments of the invention illustrated also feature separate blowers for controlling the inflow of room and outside air, which blowers have a common drive shaft extending from a single small motor in an arrangement minimizing requirements for shaft bearings and supports.

It is accordingly a primary object of the present invention to provide a window or like furnace unit which is economical to fabricate and more efficient and satisfactory in use.

Another object of the invention is to provide improvements in window furnaces and the like which are safer in operation and eliminate dangerous hot spots in their use.

An additional object of the invention is to provide a window furnace or like structure the construction of which provides for improved patterns of flow for the air utilized in the function of the furnace to service a room or like area.

Another object of the invention is to provide a window furnace or like unit having an improved housing construction featuring a unique front cover assembly enabling the function of the furnace with a comparatively high degree of safety and efficiency.

An additional object of the invention is to provide a more accurately functioning system for control of room temperature by means of a window type furnace or heater.

Another object of the invention is to provide a window furnace or like unit and components thereof possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein is shown one but obviously not necessarily the only form of embodiment of the invention, FIG. 1 is a fragmentary perspective view illustrating a window furnace or heater according to the present invention in an installed position;

Figure 1:
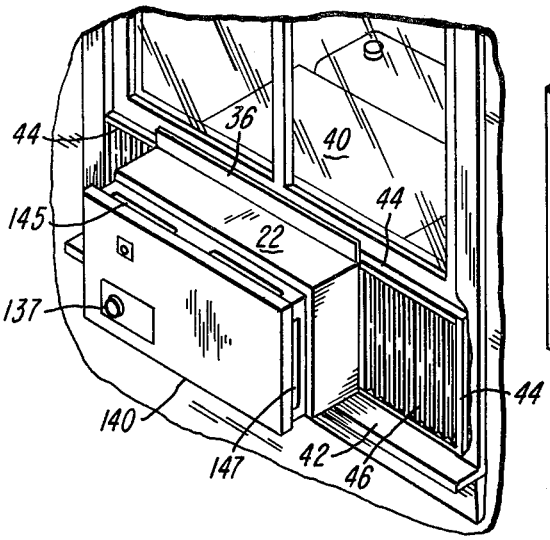
Figure 5:
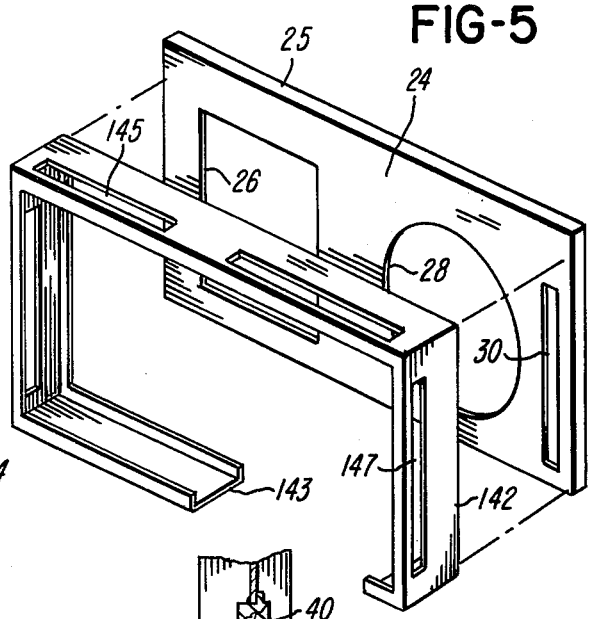
Figure 2:
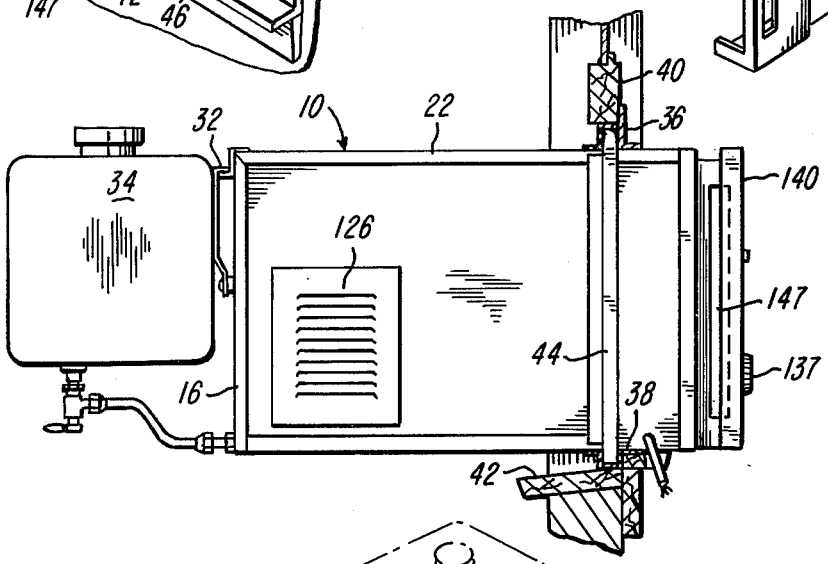
FIG. 2 is a side view of the heater of FIG. 1.
Figure 4:
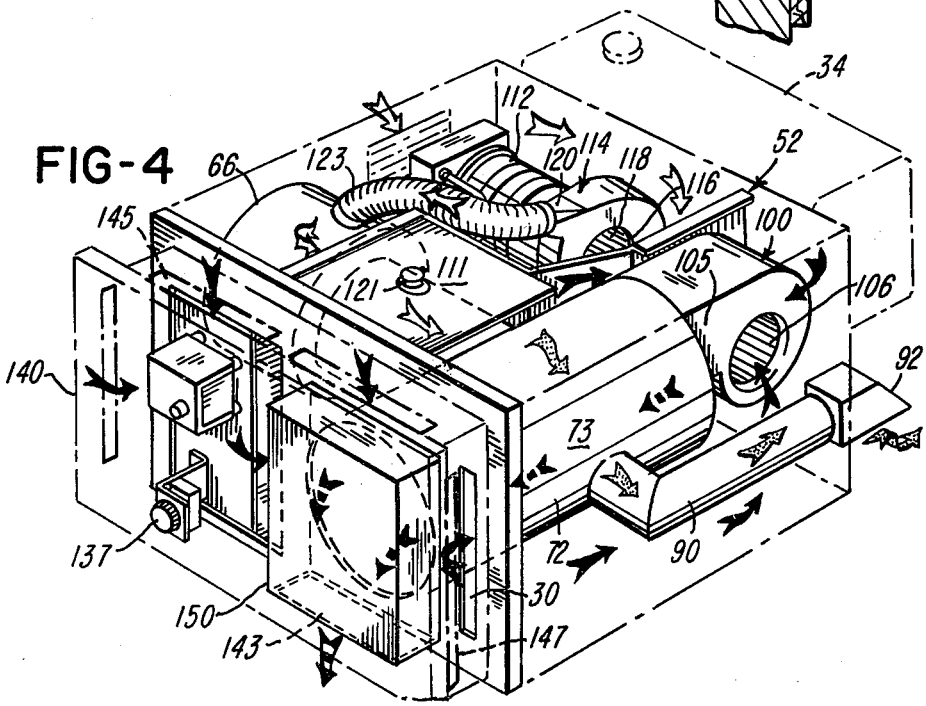

FIG. 4 is a perspective view of the unit of FIG. 1 which illustrates schematically the arrangement of its internal components and exhibits the flow pattern of the air drawn to and passed from the heater in the function thereof; and FIG. 5 of the drawings illustrates details of the spacer portion of the front cover assembly of the heater unit of FIG. 1 and the front plate of the main housing section of the heater unit to which it mounts.

Like parts are indicated by similar characters of reference throughout the several views.

Considering the orientation thereof illustrated, a preferred embodiment of the invention includes a housing 10 having a generally rectangular box-like configuration comprising a base wall 14, a back wall 16, side walls 18 and 20, a top wall 22 and a separably-related front wall 24. The wall 24 is provided by a plate the peripheral edge of which has formed integral therewith a perpendicularly related flange 25 giving the plate a cap-like configuration. In the application of the plate 24 to complete the housing its flange 25 seats about and is secured to the open front end of the housing.

As seen in FIG. 5 of the drawings, reading from left to right, plate 24 has a large rectangular aperture 26 adjacent the left hand side edge, a narrow vertically elongated aperture 30 adjacent and parallel to the right hand side edge and intermediate the apertures 26 and 30 a large circular aperture 28. The purpose of these apertures will soon become obvious.

Mounted in connection with and positioning external to the back wall 16, through the medium of a bracket 32, is a fuel storage tank 34. Fixed in connection with the exterior surface of the top plate 22, spaced intermediately of the front and back edges thereof and parallel thereto, and extending from side to side of the housing 10, is a rail member embodying a guide track 36. Dependent from the bottom of the housing 10, directly below the track 36 is a similar rail member embodying a guide track 38. In an installation of the furnace unit of the invention the rail members embodying the guide tracks 36 and 38 are respectively adapted to seat the lower edge of a window 40 and to a window sill 42 upon which the furnace unit is based. The track members 36 and 38 have end openings and to either side of the housing 10 telescopically receive the upper and lower rails of a generally rectangular U-shaped frame 44 positioned on its side. Each of the frames embody, within the limits thereof, expansible accordion pleated panel members 46. As will be obvious, the frames 44 will be projected from the sides of the housing 10 and the panel members 46 will be conventionally expanded as required to suit the particular application of the window furnace, their function being to fill the open space between the respective sides of the housing 10 and the adjacent sides of the window frame in which the furnace unit is mounted.

In closely spaced parallel relation to and immediately inward of the plate 24, extending from top to bottom of the housing 10 and from the inner wall surface portion of the side wall 18 is a metal plate structure 48 of rectangular configuration and short lateral extent. Suitable seals are provided between the plate structure 48 and those wall portions of the housing 10 in adjacent relation thereto. Attention is directed to the fact that the side, bottom, top and back wall portions of housing 10 are formed to embody therein a full and complete layer of insulation.

Figure 3:
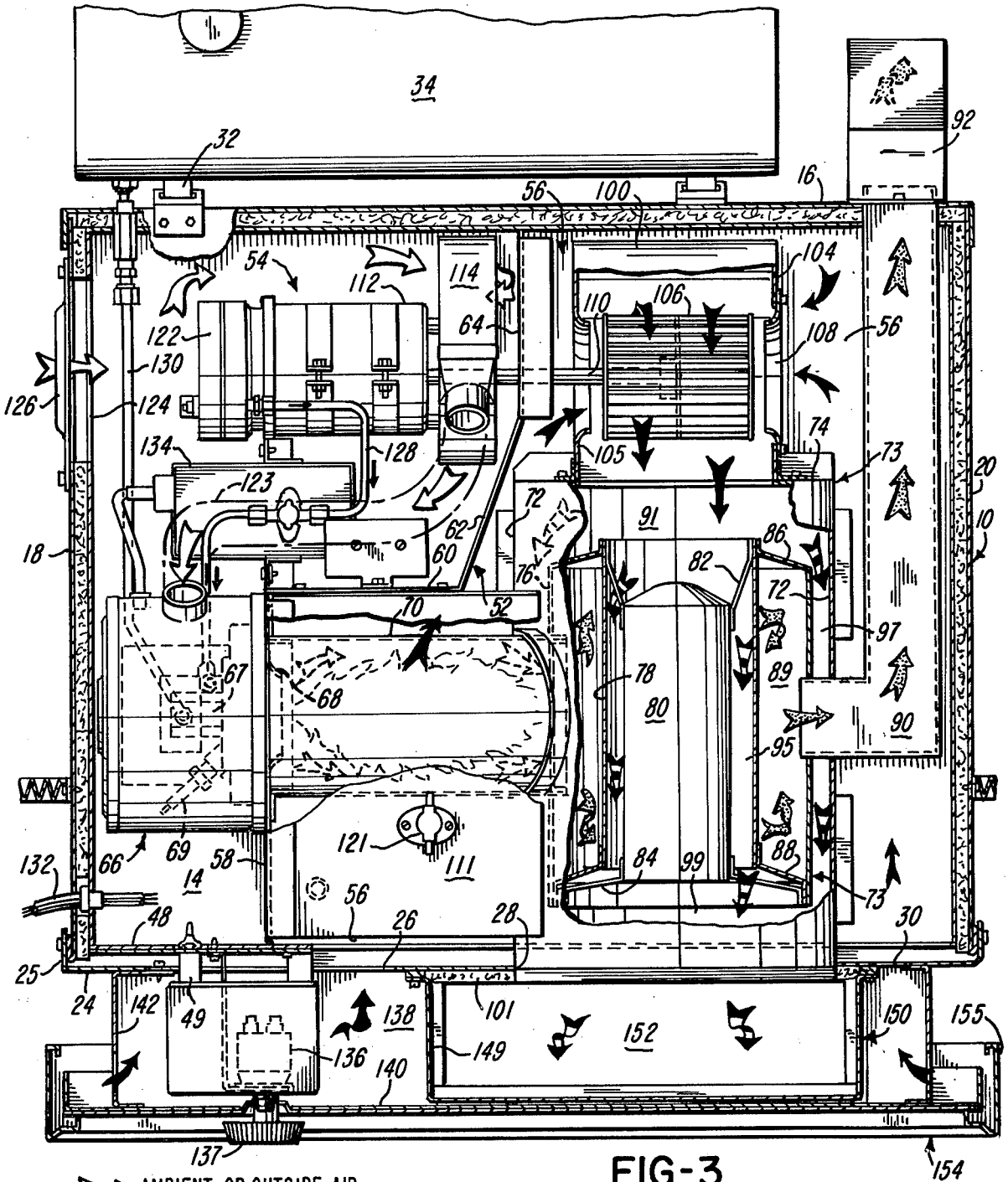
FIG. 3 is a top plan view of the heater of FIG. 1, the housing and front cover assembly portions of which are shown partly in section and portions of the structure shown interiorly of the housing are shown broken away for clarity of disclosure.

As seen in FIG. 3, welded in connection with an inner surface portion of the plate structure 48 in adjacent, parallel, spaced relation to the right hand edge thereof is one end of an irregularly shaped partition 52. The latter totally bridges the interior of the housing 10, from top to bottom and from front to rear thereof, and divides the interior of the housing into two chambers 54 and 56 which are sealed one from the other.

In a sense from front to the rear of the housing 10 the partition 52 includes a first rectangular wall section 58 which connects to and extends rearwardly of and perpendicular to the plate structure 48 for a distance which is approximately one-half the depth of the housing. In immediate following relation is a second wall section 60 which is perpendicular to the innermost limit of the wall section 58 and extended, for a relatively short distance, in the direction of and in a sense generally perpendicular to the side wall 20. The section 60 is followed by a rearwardly directed wall section 62 which forms therewith an angle of approximately 120°. The wall section 62 terminates in spaced relation to the back wall 16 and is joined to and continued by the rearmost wall section 64 of the partition 52 which connects to the rear wall 16 in a sense generally perpendicular thereto.

Mounted in the chamber 54, in connection with the wall section 58, is a burner head 66.

As illustrated in generally schematic fashion, the burner head 66 embodies a conventional aspirating type nozzle 67 the discharge end of which positions adjacent and is exposed to an opening provided in the wall section 58 which is rimmed by a conically convergent flange 68. The burner head also embodies a spark plug 69 arranged to produce a spark adjacent the discharge end of the nozzle 67.

Within the chamber 56 there is seated to the wall section 58, about and in spaced concentric relation to the flange 68, a burner tube 70. The tube 70 mounts perpendicular to the wall section 58 and extends inwardly of the chamber 56 to have its remote and open extremity project through an opening in the cylindrical shell-like housing 72 of a heat exchange 73, a seal being provided between the intersecting portions of the shell 72 and the burner tube 70. Supported within and in concentric spaced relation to the outer shell 72 of the heat exchanger, intermediate and spaced from the longitudinal extremities thereof, is a cylindrically configured shell 76 of smaller diameter, within which shell 76 there is positioned in concentrically spaced relation thereto a cylindrically configured shell 78 the axial length of which is approximately equal to that of the shell 76. As seen in the drawings, in a longitudinal sense, the innermost shell 78 is offset relative the shell 76 to have its rearmost end project beyond the rearmost end of the shell 76, in the direction of the back wall 16 of the housing 10.

The rearmost ends of the shells 76 and 78 are bridged and joined by an annular plate 86 which has a generally frusto-conical configuration. The forwardmost ends of the same shells are similarly joined by an annular plate 88 which also has a frusto-conical configuration. The plates 86 and 88 converges in the same direction and they form, together with the cylindrically configured shells 76 and 78, a cylindrical chamber 89 which is closed at each of its opposite ends. One side wall portion of the shell 76 has an aperture accommodating the projection therethrough of the open projected extremity of the tube 70, a seal being provided between the intersecting portions of the so connected parts. The connection of the delivery end of the burner tube 70 as thus provided dictates that the products of combustion and the related heat which is created therein is delivered to and fills the chamber 89. A layer of heat is thus maintained interiorly of the heat exchanger 73 which encompasses the inner shell 78 and positions in side and end spaced relation to corresponding portions of the shell 72. A side portion of the shell 76 diametrically opposite that receiving the delivery end of the tube 70 includes an aperture aligned with a similar aperture in the adjacent wall portion of the outer shell 72 and these apertures accommodate the projection therethrough of the open inlet end of an exhaust conduit member 90 the outlet end of which is projected through an opening in the back wall 16 of the housing 10. Again suitable seals are provided as between the intersecting parts. An adapter 92 fixed to the exterior surface of the back wall 16 forms a shield about the discharge end of the conduit 90 serving to direct the exhausted products of combustion which pass from the chamber 89 and to and through the conduit 90 to move downwardly and outwardly and away from the back of the housing 10.

Positioned within and in concentric spaced relation to the shell 78 by means of interconnecting strap-like elements 82 and 84 is a sealed cylindrical shell 80 the respective ends of which are capped and the rearmost end of which has a conically convergent configuration the apex of which is directed toward the back wall 16 of the housing 10 and located forwardly of the rearmost end of the shell 78. The positioning of the cylindrical shell 80 in this manner provides that it forms, with the shell 78, a tubular passage 95 to the rear end of which opens to a space 91 at the rear interior portion of the shell 72 behind the rearmost end of the shell 78. A further annular or tubular passage 97 is provided between the outer surface of the shell 76 and the adjacent inner surface of the shell 72. The passages 95 and 97 both open at one end to the space 91 at the rear interior portion of the shell 72 and at the other end to a discharge area 99 defined by the shell 72 forwardly of the forwardmost extremity of the shell 76. As will be seen from the drawings, the forwardmost or discharge end of the shell 72 projects through the aperture 28 in the plate 24. A layer of insulation 101 is provided in abutted relation to the outer surface of plate 24, about the forwardly projected extremity of the shell 72. The insulation is so applied as to insure a seal at the joint between the shell 72 and the plate 24.

The shell 72 which defines the outer wall of the heat exchanger 73 has its rearmost end capped by and suitably connected to a plate 74. The flanged base of the plate 74 is connected to the base 14 in a manner providing that the plate 74 mounts perpendicular to the bottom wall of the housing 10. The plate 74 has an aperture positioned so as to be centered with respect to the rearmost end of the shell 72 and to thus define the air inlet to the heat exchanger 73.

Immediately to the rear of the rearmost end of the shell 72 and the plate 74 is a blower unit 100. The blower 100 comprises a housing 104 containing a blower wheel 106. The housing 104 has a generally annular configuration and flat sides which are parallel to each other and to the partition wall section 64. By reason of its annular configuration the blower has air inlet openings 108 centered in each of its opposite sides. Each inlet opening 108 is rimmed by an inwardly convergent flange to accelerate the inflow of air under the influence of the rotation of the wheel 106. The wheel 106 is a rotor, the hub of which is fixedly mounted on a drive shaft 110 and the outer periphery of which includes circumferentially spaced blades. The shaft 110 extends outwardly of the blower, through the center of the inlet opening 108 most adjacent the wall section 64. A duct-like structure 105 formed integral with the housing 104 and extending tangential to the periphery of the wheel 106 extends to and is coupled with the plate 74 in rimming relation to the aperture therein which defines the air inlet of the heat exchanger 73. This places the blower outlet in a direct and coaxially aligned relation with the shell 78 and the structure of which it forms an integrated part.

A metal plate 111 mounts in connection with and perpendicular to the wall section 58 to project inwardly of the chamber 56 in an overlying relation to the burner tube 70. The plate 111 mounts a switch 121 designed to function as a limit switch to cut power to the furnace when the switch environment reaches a predetermined high temperature.

As will be seen with reference to FIGS. 3 and 4 of the drawings, the slot 30 in the plate 24 provides an opening for passage of air therethrough to the interior of the chamber 56 adjacent the right hand side of the heat exchange structure comprised of the shells 72, 76, 78 and 80 and affords a means for direct communication of air with one of the inlets 108 to the blower 100. The opening 26 is similarly in direct communication with that portion of the chamber 56 occupied by the burner tube 70 and the inlet 108 of the blower which is most adjacent the partition 52.

The shaft 110 is an extension of the drive shaft of a motor 112 located in the housing chamber 54. As seen in FIG. 3 the shaft 110 extends from the motor to and through a seal in the partition section 64 as it extends inwardly of the blower to mount the wheel 106 on its projected extremity. Mounted in side abutted relation to that end of the motor adjacent the wall section 64 is a blower 114 the composition and configuration of which is similar to that of the blower 100. As here provided the shaft 110 passes through the housing of the blower 114, through the center of its side apertures, the outermost one of which defines an air inlet 116. Within the housing of the blower 114 the shaft 110 mounts its blower wheel 118. Thus the shaft 110 mounts both blower wheels, which are therefore simultaneously driven thereby. The duct-like tangential outlet 120 of the blower 114 has in this case, a tubular configuration coupling thereto one end of a flexible conduit 123 the opposite end of which is coupled to a tubular adapter projected radially from and opening to a cavity in the interior of the burner head 66 which is in direct communication with the opening rimmed by the flange 68.

A conventional compressor unit 122 is connected to form an axial extension of that end of the motor 112 most remote from the blower 114 and thereby positioned in adjacent spaced relation to and in direct line with an opening 124 in the side wall 18 of the housing 10. The opening 124 is bridged by a filter and outwardly thereof by a slotted grill 126 designed to provide for the free inflow to the chamber 54 of air from the environment exterior to the structure in a window of which the furnace unit is mounted.

The compressor inlet is immediately adjacent the aperture 124. Under the influence of a drive of its contained rotor, outside air entering the chamber 54 is drawn interiorly of the compressor, placed under pressure and discharged in this condition, by way of its outlet, to pass to and through a small bore tube 128. The remote end of the tube 128 is coupled to an adapter on the nozzle 67 to provide that the compressed air eventually passes inwardly of the nozzle to draw fuel to and through the nozzle from the tank 34 by way of a fuel delivery line 130.

The details of the burner assembly, the nozzle 67, the compressor and the related ignition system are not here described since in and of themselves they are well known to those versed in the art and such details do not per se form a critical part of the present invention. For an understanding thereof one may look, for example, to U.S. Pat. No. 3,720,496. Suffice it to say power is provided to energize the motor 112 and the furnace ignition system by way of a cable 132 which may be plugged into any receptacle connected with a suitable source of power. FIG. 3 does illustrate the inclusion of transformer 134 which is included in the conventionally provided circuitry which embodies the transformer 134, the motor 112 and the spark plug 69 as well as the high limit switch 121 and in addition thereto a thermostat 136 and such other safety controls as are required.

The thermostat 136 mounts to brackets 49 on the outer surface of the plate structure 48. The brackets 49 are projected through the aperture 26 in the front plate 24 of the housing 10. The thermostat 136 is so mounted to position forwardly of the plate 24 and within a chamber 138.

The chamber 138 lies between the plate 24 which forms its rearmost wall and a front cover plate 140 spaced forwardly thereof by an interposed rectangular frame 142, the latter of which provides the chamber 138 with its peripheral wall surface. The frame 142 includes internal flanges which respectively seat to and in sealed engagement with the plates 24 and 140. The front cover plate 140 is cap-shaped and imperforate except for an aperture accommodating the projection therethrough of the control shaft of the thermostat 136, the outer projected extremity of which has affixed thereto a dial 137 which facilitates its manipulation.

Particular attention is directed to the fact that the dimension of frame 142 from top to bottom and from side to side is less than that of plates 24 and 140 with respect to which it is centered. Moreover, a portion of the bottom length of the frame 142 is cut away to provide an opening 143 at its bottom. Also, two side-by-side aligned, laterally spaced slots 145 are provided in the top of the frame 142 adjacent its forwardmost edge and a vertically elongated slot 147 is provided in each of its sides, also adjacent its forwardmost edge.

The slots 145 and 147 are so positioned to be overlapped in part by the peripheral flange 141 which projects rearwardly of the cap-shaped front cover plate 140 and positions in outwardly spaced relation to the sides of the frame 142.

Fixed to the outer face of the plate 24 to have its peripheral wall 149 seat perpendicular thereto, with insulation 101 interposed therebetween, and in immediate rimming relation to the aperture 28, is a rectangular box-like cap structure 150. The lowermost portion of the structure 150 depends to and to rim the cut out defining the opening 143 in the frame 142. Suitable means are applied to form a seal between the dependent portion of the box-like cap structure 150 and the furnace cover structure which bounds the opening 143. As seen in FIG. 3 the structure 150 has the walls thereof fully lined with insulation and it has an opening 152 at its bottom. As provided, the structure 150 is a duct-like structure the inlet to which receives the delivery end of the outer shell 72 of the heat exchanger 73 and the outlet from which is defined by the opening 152. The forward or outermost portion of the structure 150 is in adjacent, parallel, closely spaced relation to the front cover plate 140 and it is laterally and substantially spaced from the right hand side of the frame 142 as well as from the top of the frame.

Various safety controls in addition to the switch 121 and thermostat 136 are also included as well as controls to open the control circuit when there is an absence of flame in the combustion chamber. A reset system is included which is operable by a button accessible at the front cover. Again, since the details of the controls and the necessary circuitry are within the knowledge of those versed in the art, they are not here discussed.

A further frame 154 is in preferred embodiments placed in capping relation to the peripheral edge of the front face of the plate 140. This frame 154 includes a peripheral flange 155 which overlaps the flange 141 in outwardly spaced relation thereto and projects therebeyond to substantially overlap also the side and top slots 145 and 147 in outwardly spaced relation thereto. Note that the housing 10 as here provided is closed at the front thereof by a cover assembly the innermost portion of which is the plate 24, the outermost portion of which is the front cover plate 140 and the peripheral wall of which is defined by the spacer frame 142 the sides of which are inset and relatively sheltered. Correspondingly, the slots therein are relatively sheltered and distinctively separated to insure against intermingling of air at room temperature, which is being drawn into the chamber 138, with the heated air exiting from the furnace by way of the box-like structure 150. Particular attention is directed to the fact that the latter is not only insulated but peripherally bounded by inflowing room air and its position displaces it from the immediate vicinity of the thermostat 136. All this contributes to the fact that the thermostat 136 truly senses the temperature of the room being serviced so its relation to the temperature set therein is fully recognized. Add to this fact that the thermostat 136 is mounted by metal brackets to and immediately of the metal plate stucture 48 which is exposed to its side within the chamber 54 to outside air temperature. This enables the thermostat 136 to recognize and be affected by the recognition of outside air temperature and to correspondingly maintain a closed circuit for producing heated air in the furnace at the temperature and for the duration required to properly bring the temperature of the room being serviced to the desired level.

In the function of the furnace, the thermostat 136 is conventionally pre-set to the desired temperature level. Thereafter as power is applied to energize the motor 112 and the compressor 122 as well as the included ignition system there is developed a simultaneous drive of the blower wheels 106 and 118. The drive of the blower wheel 106 and the rotor of the compressor 122 produces an insuction of outside air to the chamber 54 by way of the grill 126 and the aperture 124. A portion of this air enters the compressor inlet and is compressed and delivered under pressure by way of the line 128, which embodies a solenoid type valve, to the discharge bore of the nozzle 67. This air delivered to the nozzle 67 functions to aspirate fuel from the tank 34 by way of the delivery line 130. The compressed air draws the fuel to and through the nozzle bore to discharge therefrom in an atomized condition adjacent the aperture defined by the flange 68 and the contacts of the spark plug 69. An additional portion of the outside air in the chamber 54 is drawn into the air inlet 116 of the blower 114 and delivered by the wheel thereof to and through the flexible conduit 123, under pressure, to enter the burner head and pass through the aperture 68 to the burner tube 70 about the flame produced by ignition of the fuel on discharge thereof from the nozzle 67. This produces a projected flame which is extended into the tube 70 and there burned. The products of combustion exit from the tube 70, together with the embodied heat, to enter the cylindrical chamber 89 within the heat exchanger 73.

The blower wheel 106, being driven simultaneously with the wheel 118, functions to apply, by reason of its two side inlets 108, a suction in the chamber 56 tending to draw air from the room being serviced by the furnace. This air is drawn into the chamber 138 by way of the relatively sheltered slots 145 and 147. In reaching these slots the air drawn from the room must move about the flanges which are in a relatively protective and sheltering relation to the recessed portions of the frame 142 including these slots. The air which is drawn in at the sides and at the top of the frame 142 immediately passes the sensing portion of the thermostat 136 and moves therefrom and from the chamber 138 to the chamber 56 by way of the aperture 26 in the plate 24. The portion of the air moving through the aperture 26 is naturally directed to and over the burner tube 70, picking up some heat in passage thereby, and drawn through an inlet aperture 108, primarily that adjacent the partition 52. At the same time air entering a remote side area of the chamber 138 is drawn inwardly of the chamber 56 along that side of the heat exchanger 73 remote from the burner tube 70 and from this area to and through the inlet 108 of the blower 100 most adjacent the side wall 20. Upon operation of the blower wheel 106 in continuing fashion the air drawn in by way of the inlets 108 will enter the interior thereof and pass outwardly therefrom through the spaces between its peripherally positioned rotor blades and be discharged thereby, by way of the duct section 105 and the aperture in the plate 74, to the space 91 in the heat exchanger 73 which is to the rear of the structure defining the chamber 89. From this space 91 the air moves in a pressured flow through the two passages 95 and 97, picking up heat from the chamber 89 by contact with the adjacent surfaces of the shells 78 and 76 embodied in the heat exchanger. The channelled flow of air thus provided by the blower 100 is one of an accelerated nature and this air, as it exits from the two passages 95 and 97 to the discharge area 99 of the heat exchanger, is immediately discharged to the interior of the insulated duct 150 and exits through its bottom opening 152. The direction of this exit, which is divorced from the area of the air inlets provided in the frame 142 is such that the heated air is directed downwardly and inwardly of the room being serviced to hit the floor thereof and move therefrom upwardly to and through the room to gradually intermingle with the air in the room and raise the temperature thereof.

The air flow pattern for that portion of the room air extracted at room temperature so developed is such that the travel thereof within the furnace is short and the path thereof is relatively controlled in a manner to insure maximum utilization of the heat available in the furnace. Moreover, the unique arrangement of the front cover assembly of the housing 10 insures against any perceptible or chance pickup of the heated air exiting from the furnace by the flow of air which is being drawn into the furnace to be subjected therein to a heating cycle.

As mentioned previously, the insulated duct section 150 as positioned in the chamber 138 is not only divorced from the incoming air in a manner to minimize chance heat transfer but incoming air is so directed to the chamber 56 as to envelope the duct section 150 in part and in this manner keep the front cover 140 decidedly cool to the touch.

The invention thus provides, in simple fashion, a highly improved and safer window furnace which is more efficient and satisfactory in use.

It is to be understood that the invention apparatus has been described only in such detail as to highlight its essential features. Such details which have not been specifically illustrated or described will be self-evident and can be contrived by mechanics versed in the art.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A window furnace comprising a housing assembly, a front panel of which is presented in the room being serviced and the rear of which is exposed to outside air, containing air heating means and means for inducing the flow thereto and therefrom of air, said housing assembly having apertures in the body thereof through one portion of which said flow inducing means draws air at room temperature for exposure to and heating by said air heating means and delivery therefrom to exit from said housing assembly by way of another portion of said apertures, said apertures being limited to areas peripheral to said housing assembly intermediate the said rear thereof and said front panel and said other portion of said apertures being remote from said one portion thereof, providing thereby that the heat of the air exiting from said housing assembly is essentially totally utilized to elevate the temperature of said room, said one portion of said apertures including one aperture adjacent to which, in said housing assembly, is a thermostat control unit; included in a circuit for controlling the operation of said furnace, in which the desired temperature of the room air may be set, which includes means to sense and compare the temperature of room air entering said housing assembly to the temperature set, said thermostat control unit being mounted to means providing a conductive exposure of said sensing means of said thermostat control unit to outside air temperatures whereby in the function thereof said thermostat control unit will take into consideration the temperature of outside air.

2. A window furnace as in claim 1 wherein said one portion of said apertures includes apertures in side and top portions of said body of said housing assembly and said other portion is located in the bottom portion of said body.

3. A window furnace as in claim 1 wherein the body of said housing assembly is generally rectangular in configuration, said one portion of said apertures includes apertures in a plurality of its sides and said front panel has flange means in connection therewith and projecting rearwardly therefrom to position in outwardly spaced and overlapping relation to the side portions of said body which include said one portion of said apertures.

4. A window furnace as in claim 1 wherein said front panel forms part of a front cover assembly for a shell comprised of back, side, top and bottom wall portions of said housing assembly, and said front cover assembly defines a chamber to the front of said shell into which said one portion of said apertures open and includes an aperture communicating said chamber with said means for inducing the flow thereto of air and said heating means includes a heat exchanger over portions of which said means for inducing the flow thereto of air is operative to move such air to be heated in passage thereby and then discharged through said other portion of said apertures.

5. A window furnace as in claim 4 wherein said heat exchanger includes a tubular structure one end of which is in sealed connection with means defining a discharge channel leading from and forming a part of said means for inducing a flow thereto of air and the opposite end of which is continued by an insulated conduit means which extends through said chamber and terminates at said other portion of said apertures where it discharges said heated air.

6. A window furnace as in claim 5 wherein said other portion of said apertures is formed in the bottom wall of said chamber and intermediate its sides.

7. A window furnace as in claim 6 wherein said insulated conduit is to the rear of and spaced from said front panel of said housing assembly and free of its respective sides.

8. A window furnace as in claim 1 wherein said front panel forms part of a cover assembly for a housing shell comprised of back, side, top and bottom walls and forms therewith said housing assembly and said front cover assembly is comprised of a structure defining a chamber including an apertured rear wall spaced from said front panel by a peripheral wall section including said one portion of said apertures, said chamber thereby defining an entry chamber exclusively receiving room air at the prevailing room temperature as said means for inducing a flow of air thereto operates.

9. A window furnace as in claim 8 wherein said peripheral wall section of said front cover assembly has a cross sectional area, in a transverse sense, which is less than that of said front panel and is so disposed as to provide that it is relatively recessed with respect to the peripheral boundaries of said front panel.

10. A window furnace as in claim 9 wherein means provide a rearwardly projected flange on peripheral portions of said front panel.

11. A window furnace as in claim 8 wherein said shell has the interior thereof divided by partition means into two sections each of which is sealed from the other, a wall portion of one of said sections having an opening to provide for said one section to receive therein outside air, a motor in said one section the drive shaft of which has in connection with one end thereof a compressor and the rotor of a blower unit mounted in said one section, a burner head mounted to said partition means in said one section to form a seal about an aperture therein and present a fuel discharge nozzle in connection therewith in exposed relation to the interior of said second section to have the discharge thereof rimmed by a combustion tube mounted to and projected from said partition means in said second section, the projected end of said combustion tube being connected to supply heat and products of combustion to said heat exchanger, said motor being energizable to draw outside air into said one section under the influence of its drive of said rotor and said compressor, said rotor and said compressor being connected to supply outside air to said burner head for combustion purposes and the said motor drive shaft being extended through said partition means to project into said second section and interiorly of a blower housing therein constituting said means for inducing a flow of air thereto and to mount within the blower housing, a blower wheel to drive the same simultaneously with the energization of said rotor.

12. A window furnace as in claim 1, said housing assembly being apertured for admission of outside air into an interior portion thereof, and said housing assembly including a heat conductive interior partition cooperating in a defining of said interior portion, said thermostat control unit mounting to said interior partition.

13. A window furnace as in claim 12, said front panel being free of air inlets and outlets and said thermostat control unit having a dial portion outside the housing assembly accessible for manipulation at the front of said front panel and having a heat sensing portion within the housing assembly mounting to said interior partition, said portions of said thermostat control unit being interconnected through said panel.

14. A window furnace as in claim 8, said peripheral wall section including said other portion of said apertures and there being duct-like structure within said chamber communicating an opening in said rear wall with said other portion of said apertures.

15. A window furnace as in claim 12, wherein said duct-like structure is in a spaced relation to said front panel.

16. A window furnace comprising a housing assembly, a front panel of which is presented in the room being serviced and the rear of which is exposed to outside air, containing air heating means and means for inducing the flow thereto and therefrom of air, said housing assembly having apertures in the body thereof through one portion of which said flow inducing means draws air at room temperature for exposure to and heating by said air heating means and delivery therefrom to exit from said housing assembly by way of another portion of said apertures, said apertures being located in a recessed portion of the periphery of said body located adjacent and to the rear of said front panel of said housing assembly, and said other portion of said apertures being remote from said one portion thereof, providing thereby that the heat of the air exiting from said housing assembly is essentially totally utilized to elevate the temperature of said room.

17. A window furnace as in claim 16 wherein said front panel has in connection therewith means defining a flange projecting rearwardly thereof and in outwardly spaced overlapping relation to the side portions of said body which include said one portion of said apertures and to the apertures therein.

18. A window furnace comprising a housing assembly, a front panel of which is presented in the room being serviced and the rear of which is exposed to outside air, containing air heating means and means for inducing the flow thereto and therefrom of air, said housing assembly having apertures in the body thereof through one portion of which said flow inducing means draws air at room temperature for exposure to and heating by said air heating means and delivery therefrom to exit from said housing assembly by way of another portion of said apertures, said front panel forming part of a cover assembly for a housing shell comprised of back, side, top and bottom walls and forming therewith said housing assembly and said front cover assembly being comprised of a structure defining a chamber including an apertured rear wall spaced from said front panel by a peripheral wall section including said one portion of said apertures, said other portion of said apertures being remote from said one portion thereof, said defined chamber forming an entry chamber exclusively receiving room air at the prevailing room temperature as said means for inducing a flow of air thereto operates, said peripheral wall section of said front cover assembly having a cross sectional area, in a transverse sense, which is less than that of said front panel and is so disposed as to provide that it is relatively recessed with respect to peripheral boundaries of said front panel, said front panel having means providing a rearwardly projected flange on peripheral portions thereof, said flange overlapping said one portion of said apertures which one portion includes apertures at the side and top of said peripheral wall section.

19. A window furnace as in claim 18 wherein said other portion of said apertures is a single aperture in the bottom of said peripheral wall section.

20. A window furnace as in claim 19 wherein said heating means includes a heat exchanger connected to receive room air from said means for inducing flow of air thereto, and said heat exchanger includes a tubular shell defining its housing one end of which projects to an aperture in the rear wall of said front cover assembly and is extended by an insulated conduit means in said chamber the discharge end of which utilizes said single aperture in said bottom of said peripheral wall section of said cover assembly to direct heated air from said furnace.

21. A window furnace as in claim 20 wherein a thermostat type control unit and its sensing means is located in said chamber to sense the temperature of entering room air and compareit to desired temperature, said thermostat type control unit being embodied in a conventional circuit to control the operation of said furnace.

22. A window furnace as in claim 21 wherein said shell has partition means dividing its interior into two sections one of which is sealed and insulated from the other, one of said sections having therein a portion of said heating means including a heat exchanger, and the other of said sections having therein another portion of said heating means providing fuel delivery means and means for igniting said fuel to furnish heat for said heat exchanger and means for delivery thereto of air to support combustion and to draw outside air for such purposes to the interior thereof through an opening in the rear of said housing assembly.

23. A window furnace as in claim 22 wherein said thermostat type control unit is mounted in said chamber by means in connection with means exposed to outside air temperature providing thereby that in operation thereof if takes into consideration the temperature of outside air.

24. A window furnace comprising a housing containing air heating means and means for inducing the flow thereto and therefrom of air, a front cover assembly in a closing relation to a front of said housing, said cover assembly including a front panel and a spacer frame projecting said panel and defining a substantially enclosed chamber between a front of said housing and said front panel, said means for inducing a flow of air from said housing directing it to said chamber, means for ducting air flowing from said housing through said chamber to an outlet in said spacer frame, and said means for inducing a flow of air to said housing utilizing a flow path including portions of said chamber external to said ducting means.

25. A window furnace according to claim 24, said flow path for air into said housing including aperture means in said spacer frame relatively remote from said outlet.

26. A window furnace according to claim 25, said ducting means being in a spaced relation to said front panel, said front panel being free of inlet and outlet apertures and maintained in a relatively cool condition.

27. A window furnace as in claim 26, wherein the front of the housing is adapted to project into a room interior whereby air induced to flow into said housing through said chamber is room air and air induced to flow out of said housing by way of said ducting means is heated air discharged into the room interior, said housing in a portion thereof adapted to project outside being apertured for admission of outside air into an interior portion of said housing, said housing including a heat conductive interior partition cooperating in a defining of said interior portion, and a thermostatic furnace control unit including a heat sensing portion mounted on said interior partition and positioning in said chamber and a manipulative dial portion presented in front of said front panel, said heat sensing portion and said dial portion being interconnected by means passing through said panel.

28. A window furnace as in claim 27, said air heating means including fuel burning means positioning in said interior portion and utilizing outside air admitted thereto for combustion, said partition being part of a partition means creating in the housing interior the first said interior portion and a second interior portion in the latter of which is air flow inducing means and a heat exchanger, said second interior portion communicating with said chamber and said partition means denying communication of the first said interior portion with said chamber, and said air heating means further including means defining a combustion chamber in an interconnecting relation to said fuel burning means and said heat exchanger, said partition means accommodating the projection therethrough of said means defining a combustion chamber.

* * * * *

UNITED STATES PATENT AND TRADEMARK OFFICE

CERTIFICATE OF CORRECTION

PATENT NO. : 4,132,353

DATED : January 2, 1979

INVENTOR(S) : Eugene C. Briggs; Robert F. Shaftner; and Harry J. Giambrone

It is certified that error appears in the above-identified patent and that said Letters Patent are hereby corrected as shown below:

Col. 4, line 65, "exchange" is corrected to read -- exchanger --.

Col. 5, line 17, "converges" is corrected to read -- converge --;

line 56, -- to -- is deleted.

Col. 6, line 62,--most--is inserted following "motor".

Col. 14, line 9, "compareit" is corrected to read -- compare it -- line 29, (Claim 23, line 5) "if" is corrected to read -- it --

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*